US007776206B2

(12) United States Patent
Miller et al.

(10) Patent No.: US 7,776,206 B2
(45) Date of Patent: Aug. 17, 2010

(54) PRODUCTION OF HIGH QUALITY LUBRICANT BRIGHT STOCK

(75) Inventors: Stephen J. Miller, San Francisco, CA (US); Russell R. Krug, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 12/191,716

(22) Filed: Aug. 14, 2008

(65) Prior Publication Data

US 2009/0120838 A1 May 14, 2009

Related U.S. Application Data

(63) Continuation of application No. 10/659,012, filed on Sep. 9, 2003, now abandoned.

(51) Int. Cl.
*C10G 69/02* (2006.01)

(52) U.S. Cl. ..... 208/60

(58) Field of Classification Search ..... 208/46, 208/49, 58, 60

See application file for complete search history.

(56) References Cited

U.S. PATENT DOCUMENTS

| | | | | |
|---|---|---|---|---|
| 3,830,732 | A | 8/1974 | Gatsis | |
| 3,852,207 | A | 12/1974 | Stangeland | |
| 3,904,513 | A | 9/1975 | Fischer et al. | |
| 3,923,636 | A | 12/1975 | Mead et al. | |
| 4,125,459 | A | 11/1978 | Garwin | |
| 4,157,294 | A | 6/1979 | Iwao et al. | |
| 4,440,871 | A | 4/1984 | Lok et al. | |
| 4,673,487 | A | 6/1987 | Miller | |
| 4,747,932 | A | 5/1988 | Miller | |
| 4,923,424 | A | 5/1990 | Shaffer | |
| 4,925,558 | A | 5/1990 | Kappenberger | |
| 5,135,638 | A | 8/1992 | Miller | |
| 5,158,665 | A | 10/1992 | Miller | |
| 5,282,956 | A | 2/1994 | Santilli et al. | |
| 5,833,837 | A * | 11/1998 | Miller | 208/27 |
| 6,001,886 | A | 12/1999 | Shirodkar | |
| 6,317,654 | B1 | 11/2001 | Gleeson et al. | |
| 6,337,010 | B1 | 1/2002 | Hofer | |
| 6,468,418 | B1 * | 10/2002 | Biscardi et al. | 208/28 |
| 6,488,418 | B2 | 10/2002 | Biscardi et al. | |
| 6,569,313 | B1 | 5/2003 | Carroll et al. | |
| 2003/0075477 | A1 * | 4/2003 | Miller | 208/27 |

FOREIGN PATENT DOCUMENTS

| | | |
|---|---|---|
| WO | WO 00/11113 | 3/2000 |

* cited by examiner

*Primary Examiner*—Glenn Caldarola
*Assistant Examiner*—Randy Boyer
(74) *Attorney, Agent, or Firm*—Steven H. Roth

(57) ABSTRACT

A process for producing a lubricant bright stock from a very heavy feed obtained from a petroleum crude is disclosed. The bright stock produced by the present process has a reduced cloud point and better oxidation stability relative to bright stocks prepared by conventional methods. The process comprises the steps of providing a petroleum residuum-derived stream; separating the residuum-derived stream at a distillation cut point in the range of 1150° F. to 1300° F., into a heavy fraction and at least one light fraction; hydrocracking the at least one light fraction under conditions to reduce the concentration of sulfur and nitrogen to suitable levels for hydroisomerization dewaxing; and dewaxing at least a portion of the hydrocracked stream under hydroisomerization conditions to produce a lubricant bright stock.

18 Claims, No Drawings

PRODUCTION OF HIGH QUALITY LUBRICANT BRIGHT STOCK

FIELD OF THE INVENTION

The present invention relates to a process for producing a high quality lubricant bright stock from heavy petroleum feedstocks.

BACKGROUND OF THE INVENTION

This invention is directed to a process for preparing a high quality lubricant bright stock from heavy petroleum feedstocks. These heavy feedstocks are often contaminated with sulfur, nitrogen, asphaltenic and metal contaminants, which must be removed in preparing the lubricant base stock. They also generally contain significant amounts of waxy materials.

Low valued oils such as deasphalted oil (DAO) are increasingly being hydrotreated and used as FCC cracker feed to produce gasoline. Severity of deasphalting is much less for making fuels than for making lubricant bright stock. Consequently, the purity of fuels-application DAO is too low to make lubricant bright stock with adequate stability for use in finished lubricant applications. However, increasingly stringent mandated limits on gasoline sulfur require higher severity in fuels DAO hydrotreating. These changes improve the quality of DAO as a feed to hydrocracking to produce high viscosity lubricant base oils. Nevertheless, the highest boiling portion of DAO contains high molecular weight waxes which are difficult to remove, leading to low yields of high cloud point products. The highest boiling fractions also contain large polycyclic molecules, which are difficult to completely saturate in hydrofinishing and which lead to stability problems.

Conventional high quality Group II lubricant neutral oils having excellent oxidation stability, good low temperature properties and high viscosity indices are generally made by hydrocracking gas oils, followed by dewaxing and optionally mild hydrotreating. Lubricant base stocks having viscosities of up to about 100 cSt, measured at 40° C., are made in this manner. Higher viscosity oils, for example, bright stocks and similar oils with viscosities of 220 cSt or greater, are generally not made by isomerization dewaxing and generally do not posses the high quality of Group II base oils prepared by isomerization dewaxing. High viscosity oils of improved quality are in general demand, especially for non-engine oil applications, such as industrial oils.

Such high viscosity oils generally require some bright stock in their formulation, the amount of which depends on the product. In typical formulations, Group I bright stock is used, which degrades the product when blended with neutral oil. One problem with the quality of bright stock is that it is not a distillate and is typically of low quality, particularly with respect to oxidation stability. Thus, there is a need for a method for producing an oxidation stable, good quality lubricant bright stock.

In addition, feedstocks which are useful for making lubricant bright stock have generally been limited to gas oils, and specifically vacuum gas oils. Residuum streams are generally difficult to process for lubricant base oils. Not only are the sulfur, nitrogen and aromatic contents of residuum streams very high, but the waxy materials present in these residuum streams are difficult to process in the production of low pour point base oil products. It is especially, therefore, to be able to produce good quality lubricant bright stock from residuum-derived streams.

SUMMARY OF THE INVENTION

The present invention relates to a process for producing a lubricant bright stock from a very heavy feed, having a normal boiling end point within the range of 1150° F. to 1300° F. The very heavy feed is obtained from petroleum crude. The bright stock produced by the present process has a reduced cloud point and better oxidation stability relative to bright stocks prepared by conventional methods.

The present invention provides a process for producing a stable lubricant bright stock comprising the steps of providing a petroleum residuum-derived stream having a sulfur content of less than 1% and a nitrogen content of less than 0.5%; separating the residuum-derived stream at a distillation cut point in the range of 1150° F. to 1300° F., into a heavy fraction and at least one light fraction; hydrocracking the at least one light fraction under lube hydrocracking in a lube hydrocracking zone in the presence of a hydrocracking catalyst and hydrogen under conditions to reduce the concentration of sulfur and nitrogen to suitable levels for hydroisomerization dewaxing; and dewaxing at least a portion of the hydrocracked stream in a hydroisomerization zone in the presence of an isomerization catalyst and hydrogen under hydroisomerization conditions to produce a lubricant bright stock.

In one embodiment, a vacuum residuum fraction, which is optionally hydrotreated/hydrocracked prior to further treating, is separated in a high temperature fractionation step, at a cut point temperature in the range of 1150° F. to 1300° F., into at least a heavy fraction and a light fraction. The light fraction is further processed by hydroisomerization dewaxing to prepare a low haze bright stock.

Conventional methods for preparing bright stock by hydroisomerization dewaxing a vacuum residuum fraction, a hydrocracked vacuum residuum fraction, deasphalted oil or hydrocracked deasphalted oil generally produces a bright stock with unacceptable haze-forming tendencies.

Among other factors, the present invention is based on the surprising discovery that the high temperature fractionation, with a cut point in the range of 1150° F. to 1300° F., concentrates the haze-forming components found in the vacuum residuum fraction in the heavy fraction, and provides a low haze, and relatively low sulfur containing light fraction which can be processed using conventional methods for preparing a bright stock lubricant. The preferred method of fractionating at the high temperatures required to achieve the desired separation is a short path distillation, such as a wiped film evaporator.

DETAILED DESCRIPTION

Feed Stream:

The petroleum feed stream which is treated in the present invention is a residuum fraction, derived from the fractionation of a petroleum feed, preferably a crude feed. Other feeds which may be treated in the present invention include deasphalted oil, heavy coker products, and the like.

Deasphalted oil (DAO) may be recovered from a conventional deasphalting process, such as a solvent deasphalting process. Such processes are well known in the art. A process for preparing a DAO which is useful in the present invention is described, for example, in U.S. Pat. No. 6,001,886, which is incorporated by reference. In a deasphalting process, a residuum is subjected to counter-current contacting at solvent deasphalting conditions, generally at a temperature in the range of 50° F. to 400° F., preferably 150° F. to 300° F., a dosage of from 0.5 to 10, preferably 1.0 vol. to 3.0 vol. solvent/vol. oil and a pressure of atmospheric pressure to 400 psig, preferably atmospheric pressure to 50 psig. The actual deasphalting conditions chosen are dependent on the solvent. That is, the temperature chosen should not exceed the critical temperature of the solvent and the pressure is maintained above the autogenous pressure to prevent vaporization. Deasphalted oil and solvent are removed by distillation or by stripping the asphalt layer, leaving behind a viscous asphaltic residue. Deasphalting solvents which are useful for this purpose include $C_2$ to $C_8$ paraffins, furfural and N-methyl-2-pyrrolidone. Propane and butane are preferred. Pentane is the most suitable solvent if high yields of deasphalted oil are desired. These lower-boiling paraffinic solvents may also be used as mixtures with alcohols such as methanol and isopropanol. Propane as a solvent results in the lowest yield of deasphalted oil and highest yield of asphaltic residue. Because propane is the preferred commercial solvent, the process is often referred to as propane deasphalting. Isobutane and n-butane are also used commercially. The Rose (Residual Oil Solvent Extraction) process has been the object of many patents disclosing different operating conditions, or the use of several solvents as specified, for example, in U.S. Pat. Nos. 3,830,732 and 4,125,459. The preferred solvent in the Rose process is pentane. The Rose process includes a step under supercritical conditions adapted to separate the solvent from the deasphalted oil.

Hydrotreating/Hydrocracking the Residuum Feed:

The residuum feed stream is optionally upgraded as necessary prior to separation in the deep cut distillation stage. The feed to the deep cut distillation should have a sulfur content of less than 1% and a nitrogen content of less than 0.5%. The method of upgrading depends, at least in part, on the quality of the feedstock and the quality of the desired bright stock lubricant product. For example, the feed stream may desirably be hydrotreated to remove sulfur without extensive molecular weight conversion by hydrocracking. As used here, the upgrading step prior to separation is identified as a hydrotreating/hydrocracking step to indicate the range of upgrading severities which may be used in the present process.

Hydrotreating refers to a catalytic process, usually carried out in the presence of free hydrogen, in which the primary purpose is the desulfurization and/or denitrification of the feed stock. Generally, in hydrotreating operations, cracking of the hydrocarbon molecules (i.e., breaking the larger hydrocarbon molecules into smaller hydrocarbon molecules) is minimized and the unsaturated hydrocarbons are either fully or partially hydrogenated. Hydrotreating conditions include a reaction temperature between 400° F. to 900° F. (204° C. to 482° C.), preferably 650° F. to 850° F. (343° C. to 454° C.); a pressure between 500 psig to 5000 psig (pounds per square inch gauge) (3.5 MPa to 34.6 MPa), preferably 1000 psig to 3000 psig (7.0 MPa to 20.8 MPa); a feed rate (LHSV) of 0.5 $hr^{-1}$ to 20 $hr^{-1}$ (v/v); and overall hydrogen consumption 300 to 2000 standard cubic feet per barrel of liquid hydrocarbon feed (53.4-356 $m^3H_2/m^3$ feed). The hydrotreating catalyst for the beds will typically be a composite of a Group VI metal or compound thereof, and a Group VIII metal or compound thereof supported on a porous refractory base such as alumina and silica-alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

Hydrocracking is a process of breaking larger hydrocarbon molecules into smaller ones. It can be affected by contacting the particular fraction or combination of fractions, with hydrogen in the presence of a suitable hydrocracking catalyst. The hydrocracking step reduces the size of the hydrocarbon molecules, hydrogenates olefin bonds, hydrogenates aromatics, opens rings, and removes traces of heteroatoms. Typical hydrocracking conditions include: reaction temperature, 400° F. to 950° F. (204° C. to 510° C.), preferably 650° F. to 850° F. (343° C. to 454° C.); reaction pressure 500 psig to 5000 psig (3.5 MPa to 34.5 MPa), preferably 1500 psig to 3500 psig (10.4 MPa to 24.2 MPa); liquid hourly space velocity (LHSV), 0.1 $hr^{-1}$ to 15 $hr^{-1}$ (v/v), preferably 0.25 $hr^{1}$ to 2.5 $hr^{1}$; and hydrogen consumption 500 to 2500 standard cubic feet per barrel of liquid hydrocarbon feed (89.1-445 $m^3H_2/m^3$ feed). The hydrocracking catalyst generally comprises a cracking component, a hydrogenation component, and a binder. Such catalysts are well known in the art. The cracking component may include an amorphous silica-alumina phase and/or a zeolite, such as a Y-type or USY zeolite. The binder is generally silica, alumina or silica-alumina. The hydrogenation component will be a Group VI or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

Deep Cut Distillation:

Once a suitable residuum-derived petroleum feedstock has been obtained, it is next separated into a heavy fraction and a light fraction by a deep cut distillation. The deep cut distillation separates the heavy feed stream at a cut point in the range of 1150° F. to 1300° F. into a heavy fraction and a light fraction, the latter of which undergo further separation by distillation. The cut point is the temperature at which there are equal amounts of material overlapping from adjacent cuts. When data is not available for one or both adjacent cuts, cut point estimates are the 10 and 90 percent points of the distillation curve. The heavy fraction has a boiling point predominantly above the cut point and the at least one light fraction has a boiling point predominantly below the cut point. The heavy fraction may be used as feed to the FCC or recycled to the hydrocracker. At least a portion of the light fraction is used as a feedstock for hydrocracking discussed more fully below.

Special care is required to separate very high boiling materials in order to minimize product degradation. WO 00/11113, which is incorporated herein by reference, describes the use of special packing, stream stripping and high vacuum to achieve high temperature separations without product degradation. Other commercially available methods employ techniques developed as molecular distillation methods. These are described in detail in, for example, G. Burrows, *Molecular Distillation*, Oxford: Clarendon Press, 1960. Such short-path distillation methods include falling film evaporators and wiped film evaporators. An example of short path distillation is described in U.S. Pat. No. 4,925,558, incorporated herein by reference.

The American Society for Testing and Materials (ASTM) has established guidelines for simulated distillation analyses, which include samples that have atmospheric equivalent boiling points (AEBP) in the range of about −44° F. to 1139° F. These include ASTM Methods D2887 and D3710. ASTM Method D2887 has an upper temperature limit for petroleum products with a final boiling point of 1000° F. at atmospheric pressure. For analysis of heavier samples, such as crude oils, HTSD method D6352 extends the AEBP distribution to temperatures upwards of 1300° F. to 1380° F. So, the cut point of the deep cut distillation of the present invention should be determined by ASTM method D6352 or an equivalent method. In practice, ASTM method D6352 gives distillation curve data as output and not cut point. Those skilled in the art know that such distillation curve data are primary requisites for cut point determination. Cut points are typically at 10 and 90 percent points on distillation curves. These 10 and 90 percent points are much more reliably measured than the start and end point, because they are much less dependent on details of D6352 execution (such as manufacturer of equipment and selection of computer software). Of course, as noted above, exact cut point determination requires knowledge of adjacent cut distillation curves and relative amounts.

Hydrocracking:

At least a portion of the light fraction from the deep cut distillation is hydrocracked in a lube hydrocracking zone in the presence of a hydrocracking catalyst and hydrogen under conditions to reduce the concentration of sulfur and nitrogen to suitable levels for hydroisomerization dewaxing. The lube hydrocracking conditions should also be selected to increase the VI to meet VI specifications. Typically the solvent dewaxed VI of the feed should be greater than 90 and preferably greater than 95. The concentration of nitrogen in the feed for hydroisomerization dewaxing should be less than 50 ppm, preferably less than 30 ppm, and more preferably less than 10 ppm. The concentration of sulfur in the feed for hydroisomerization dewaxing should be less than 100 ppm, preferably less than 50 ppm and more preferably less than 20 ppm.

Therefore, hydrocracking conditions for hydrocracking the light fraction recovered from deep cut distillation, as broadly described, corresponds to hydrocracking conditions for hydrocracking the waxy heavy feed stream. Typical hydrocracking conditions include: reaction temperature, 400° F. to 950° F. (204° C. to 510° C.), preferably 650° F. to 850° F. (343° C. to 454° C.); reaction pressure 500 psig to 5000 psig (3.5 MPa to 34.5 MPa), preferably 1500 psig to 3500 psig (10.4 MPa to 24.2 MPa); liquid hourly space velocity (LHSV), 0.1 $hr^{-1}$ to 15 $hr^{-1}$ (v/v), preferably 0.25 $hr^{-1}$ to 2.5 $hr^{-1}$; and hydrogen consumption 500 to 2500 standard cubic feet per barrel of liquid hydrocarbon feed (89.1-445 $m^3H_2/m^3$ feed). The hydrocracking catalyst generally comprises a cracking component, a hydrogenation component, and a binder. Such catalysts are well known in the art. The cracking component may include an amorphous silica-alumina phase and/or a zeolite, such as a Y-type or USY zeolite. The binder is generally silica, alumina or silica-alumina. The hydrogenation component will be a Group VI or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

Hydroisomerization:

At least a portion of the effluent from the lube hydrocracking is subjected to hydroisomerization dewaxing to produce a low haze bright stock.

Hydroisomerization dewaxing catalysts useful in the present invention generally comprise one or more shape selective intermediate pore size molecular sieves and optionally a catalytically active metal hydrogenation component on a refractory oxide support. The shape selective intermediate pore size molecular sieves used alone or in combination in the practice of the present invention are generally 1-D 10-, 11-, or 12-ring molecular sieves. The preferred molecular sieves of the invention are of the 1-D 10-ring variety, where 10-(or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization dewaxing are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization dewaxing are zeolites, such as ZSM-22, ZSM-23, ZSM-35, ZSM-48, ZSM-57, SSZ-32, offretite, and ferrierite. SSZ-32 and ZSM-23 are more preferred.

A particularly preferred intermediate pore size molecular sieve, which is useful in the present process, is described, for example, in U.S. Pat. Nos. 5,135,638 and 5,282,958, the contents of which are hereby incorporated by reference in their entirety. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å. The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40 or greater (isomerization selectivity is determined as follows: 100× (weight % branched $C_{16}$ in product)/(weight % branched $C_{16}$ in product+weight % $C_{13-}$ in product) when used under conditions leading to 96% conversion of normal hexadecane (n-$C_{16}$) to other species.

Such a particularly preferred molecular sieve may further be characterized by pores or channels having a crystallographic free diameter in the range of from about 4.0 Å to about 7.1 Å, and preferably in the range of 4.0 Å to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pages 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al., J. Catalysis 58, 114 (1979); and U.S. Pat. No. 4,440,871, which is incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes (p/po=0.5; 25° C.). Intermediate pore size molecular sieves will typically admit molecules having kinetic diameters of 5.3 Å to 6.5 Å with little hindrance.

Hydroisomerization dewaxing catalysts useful in the present invention optionally comprise a catalytically active hydrogenation metal. Typical catalytically active hydrogenation metals used alone or in combination include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 to 5 weight % of the total catalyst, usually from 0.1 to 2 weight %, and not to exceed 10 weight %.

The refractory oxide support may be selected from those oxide supports which are conventionally used for catalysts, including silica, alumina, silica-alumina, magnesia, titania and combinations thereof.

The catalytic hydroisomerization conditions employed depend on the feed used for the hydroisomerization and the desired pour point of the product. Generally, the temperature is from about 200° C. to about 475° C., preferably from about 250° C. to about 450° C. The pressure is typically from about psig to about 3000 psig, preferably from about 50 psig to about 2500 psig, more preferably from about 100 psig to about 1000 psig, and most preferably from about 150 psig to about 600 psig. The liquid hourly space velocity (LHSV) is preferably from about 0.1 $hr^{-1}$ to about 20 $hr^{-1}$, more preferably from about 0.1 $hr^{-1}$ to about 5 $hr^{1}$, and most preferably from about 0.1 $hr^{-1}$ to about 1.0 $hr^{1}$. Low pressure and low liquid hourly space velocity provide enhanced isomerization selectivity, which results in more isomerization and less cracking of the feed, thus producing an increased yield.

Hydrogen is preferably present in the reaction zone during the catalytic isomerization process. The hydrogen to feed ratio is typically from about 500 SCF/bbl to about 30,000 SCF/bbl (standard cubic feet per barrel), preferably from about 1000 SCF/bbl to about 20,000 SCF/bbl.

Hydrofinishing:

The product from the hydroisomerization step may optionally be hydrofinished in order to stabilize the lubricant product by reducing olefins and aromatics. Hydrofinishing is typically conducted at temperatures ranging from about 300° F. to about 600° F., at pressures from about 400 psig to about 3000 psig, at space velocities (LHSV) from about 0.1 to about 20, and hydrogen recycle rates of from about 400 SCF/bbl to about 1,500 SCF/bbl. The hydrogenation catalyst employed must be active enough not only to hydrogenate the olefins, diolefins and color bodies within the lube oil fractions, but also to reduce the aromatic content (color bodies). The hydrofinishing step is beneficial in preparing an acceptably stable lubricating oil. Suitable hydrogenation catalysts include conventional metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites. Palladium is a particularly preferred hydrogenation metal. If desired, non-noble Group VIII metals can be used with molybdates. Metal oxides or sulfides can be used. Suitable catalysts are disclosed in U.S. Pat. Nos. 3,852,207; 4,157,294; 3,904,513 and 4,673,487, which are incorporated by reference herein.

Additionally, U.S. Pat. No. 6,337,010, which is incorporated by reference herein discloses a process scheme for producing lubricating base oil with low pressure dewaxing and high pressure hydrofinishing and discloses operating conditions for lube hydrocracking, isomerization and hydrofinishing that may be useful in practicing the present invention.

Clay Treating:

The low haze heavy base oil may optionally also be treated by a clay treating step, either following hydroisomerization or following hydrofinishing to remove any remaining traces of haze or haze precursors. A suitable clay treating process is described, for example, in U.S. Pat. No. 6,468,418, which is incorporated by reference.

The following example is intended to illustrate the present invention and is not intended to limit the invention in any way.

EXAMPLE

The following example describes a method of the invention for preparing low haze bright stock. An Alaska North Slope/Arabian Light/Arabian Medium crude blend was fractionated in an atmospheric/vacuum distillation and the vacuum column bottoms upgraded by solvent deasphalting and the DAO hydrocracked. The de-asphalting process and the hydrocracking process were conventional.

The residuum (i.e., bottoms) fraction from an atmospheric fractionation of the hydrocracked DAO was topped by vacuum distillation at 700° F., and the residuum fraction separated by wiped film evaporator distillation at a 1200° F. cut point. The 1200° F.+ bottoms portion was 13.3 weight % of the 700° F.+ fraction.

The 700° F. to 1200° F. distillate had the following properties:

| | | |
|---|---|---|
| API Gravity | 20.7 | |
| Nitrogen, ppm | 988 | |
| Sulfur, ppm | 2227 | |
| Viscosity, cSt, 100° C. | 21.55 | |
| Viscosity Index | 70 | |
| Sim. Dist., weight %, ° F., D6352 | | |
| | 10% | 767 |
| | 50% | 977 |
| | 90% | 1158 |

This feed was hydrocracked using a conventional commercial Ni—W—SiO2-Al2O3 hydrocracking catalyst at 720/732° F. reaction temperature (2 catalyst zones) at 2052 psig pressure (1968 psia $H_2$ pressure), 0.25 $hr^{-1}$ feed rate, and 5200 SCFB recycle $H_2$ rate, and the hydrocracker effluent separated first in conventional flash separation zones and then by atmospheric/vacuum distillation. The bright stock (i.e., bottoms) fraction from the vacuum distillation was at a yield of 22.7 vol % and had the following properties:

| | | |
|---|---|---|
| API Gravity | 27.1 | |
| Nitrogen, ppm | 7 | |
| Sulfur, ppm | 14 | |
| Viscosity, cSt, 100° C. | 25.67 | |
| Viscosity Index | 97 | |
| Wax, weight % | 16.3 | |
| Sim. Dist., weight %, ° F., D6352 | | |
| | 10% | 943 |
| | 30% | 1026 |
| | 50% | 1070 |
| | 70% | 1117 |
| | 90% | 1182 |

The bright stock was converted by isomerization dewaxing at 610° F. reaction temperature at 1950 psig pressure (1878 psia $H_2$ pressure), 1.3 $hr^{-1}$ feed rate, and 3000 SCFB once-through $H_2$ rate, over a Pt/SSZ-32 catalyst (containing 35% alumina binder), followed by hydrofinishing at 450° F., 1950 psig pressure, 1.0 $hr^{-1}$ feed rate, and 3000 SCFB once-through $H_2$ rate, over a Pt—Pd/$SiO_2$—$Al_2O_3$ catalyst, into a low haze bright stock lubricant product having the following properties:

| | | |
|---|---|---|
| API Gravity | 27.0 | |
| Viscosity, cSt | | |
| | (measured at 40° C.) | 355.7 |
| | (measured at 100° C.) | 25.68 |
| Viscosity Index | 95 | |
| Pour Point, ° C. | −20° | |
| Cloud Point, ° C. | +2° | |
| Oxidator BN, hrs | 21.5 | |
| Distillation by D6352, weight %, ° F. | | |
| | 10% | 956 |
| | 30% | 1009 |
| | 50% | 1054 |
| | 70% | 1090 |
| | 90% | 1135 |

Lube yield was 94.7 weight %. Conducting the same set of reaction steps, using a full bottoms fraction from the hydrocracked DAO would be expected to produce an isomerization dewaxing/hydrofinishing product having a cloud point of at least 15° C.

By contrast, solvent dewaxing the same bright stock feed produced an oil with a pour point of −21° C. but a VI of only 92. Furthermore, the yield of oil was only 83.7 weight %.

What is claimed is:

1. A process for producing stable lubricant bright stock having a viscosity, measured at 100° C., of greater than 15 cSt comprising the steps of:

a) providing a petroleum vacuum residuum-derived stream having a sulfur content of less than 1% and a nitrogen content of less than 0.5%;

b) separating the vacuum residuum-derived stream at a distillation cut point in the range of 1150.degree. F. to 1300.degree. F., into a heavy fraction and at least one light fraction having an upper boiling range of 700° F. or greater;

c) hydrocracking the at least one light fraction under lube hydrocracking in a lube hydrocracking zone in the presence of a hydrocracking catalyst and hydrogen under conditions to reduce the concentration of sulfur and nitrogen to suitable levels for hydroisomerization dewaxing; and d) dewaxing at least a portion of the hydrocracked stream in an hydroisomerization zone in the presence of a hydroisomerization catalyst and hydrogen under hydroisomerization conditions to produce a lubricant bright stock having a viscosity, measured at 100° C., of greater than 15 cSt.

2. The process of claim 1, wherein the petroleum residuum-derived stream is a hydrocracked deasphalted oil.

3. The process of claim 1, wherein the petroleum residuum-derived stream is a hydrocracked residuum.

4. The process of claim 1, wherein the petroleum residuum-derived stream has a concentration of sulfur of less than 0.5% and a concentration of nitrogen of less than 0.2%.

5. The process of claim 1, further comprising stabilizing the lubricant bright stock in a hydrofinishing zone in the presence of a hydrofinishing catalyst and hydrogen under hydrofinishing conditions.

6. The process of claim 5, further comprising contacting the stabilized lubricant bright stock with clay in a clay treatment zone.

7. The process of claim 1, wherein the bright stock has a viscosity, measured at 100.degree. C., of greater than 15 cSt and viscosity index of greater than 80.

8. The process of claim 7, wherein the bright stock has a viscosity index of greater than 90.

9. The process of claim 1, wherein the bright stock has a viscosity in the range of 20 and 60 cSt, measured at 100.degree. C.

10. The process according to claim 1, wherein the hydroisomerization catalyst is selected from the group consisting of SAPO-11, SAPO-31, SAPO-41, SM-3, ZSM-22, ZSM-23, ZSM-35, ZSM-48, ZSM-57, SSZ-32, offretite, ferrierite and combinations thereof.

11. The process according to claim 10, wherein the hydroisomerization catalyst is selected from the group consisting of SAPO-11, SAPO-31, SM-3, SSZ-32, and ZSM-23.

12. The process according to claim 11, wherein the hydroisomerization catalyst is selected from the group consisting of SAP0-11, SM-3, SSZ-32, and ZSM-23.

13. The process according to claim 1, wherein the hydroisomerization catalyst has a metal hydrogenation component.

14. The process according to claim 13, wherein the metal hydrogenation component is platinum, palladium, or a mixture thereof.

15. The process according to claim 10 wherein the metal hydrogenation component is platinum.

16. The process according to claim 1, wherein the suitable levels for hydroisomerization dewaxing include a concentration of nitrogen of less than 50 ppm and a concentration of sulfur of less than 100 ppm.

17. The process according to claim 1, wherein the suitable levels for hydroisomerization dewaxing include a concentration of nitrogen of less than 30 ppm and a concentration of sulfur of less than 50 ppm.

18. The process according to claim 1, wherein the suitable levels for hydroisomerization dewaxing include a concentration of nitrogen of less than 10 ppm and a concentration of sulfur of less than 20 ppm.

* * * * *

UNITED STATES PATENT AND TRADEMARK OFFICE

CERTIFICATE OF CORRECTION

PATENT NO. : 7,776,206 B2
APPLICATION NO. : 12/191716
DATED : August 17, 2010
INVENTOR(S) : Stephen J. Miller et al.

It is certified that error appears in the above-identified patent and that said Letters Patent is hereby corrected as shown below:

In claim 1, line 57, please delete "1150.degree.F." and insert --1150°F.-- in place thereof;

In claim 1, line 58, delete "1300.degree.F." and insert --1300°F.-- in place thereof;

In claim 7, line 25, please delete "100.degree.C." and insert --100°C.-- in place thereof;

In claim 9, line 31, please delete "100.degree.C." and insert --100°C.-- in place thereof;

Signed and Sealed this

Twenty-third Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,776,206 B2
APPLICATION NO. : 12/191716
DATED : August 17, 2010
INVENTOR(S) : Stephen J. Miller et al.

It is certified that error appears in the above-identified patent and that said Letters Patent is hereby corrected as shown below:

In claim 1, column 9, line 57, please delete "1150.degree.F." and insert --1150°F.-- in place thereof;

In claim 1, column 9, line 58, delete "1300.degree.F." and insert --1300°F.-- in place thereof;

In claim 7, column 10, line 25, please delete "100.degree.C." and insert --100°C.-- in place thereof;

In claim 9, column 10, line 31, please delete "100.degree.C." and insert --100°C.-- in place thereof;

This certificate supersedes the Certificate of Correction issued November 23, 2010.

Signed and Sealed this

Fourteenth Day of December, 2010

David J. Kappos

David J. Kappos
*Director of the United States Patent and Trademark Office*